US007979944B1

(12) United States Patent
Martin, III et al.

(10) Patent No.: US 7,979,944 B1
(45) Date of Patent: Jul. 19, 2011

(54) TUBULAR CLEANING DEVICE

(75) Inventors: John C. Martin, III, Katy, TX (US); Louis P. Vickio, Jr., Houston, TX (US); Harold Wilson, Jr., Beckville, TX (US); James V. Young, Jr., Missouri City, TX (US)

(73) Assignee: Bluewater Pipeline Solutions LLC, Katy, TX (US)

( * ) Notice: Subject to any disclaimer, the term of this patent is extended or adjusted under 35 U.S.C. 154(b) by 0 days.

(21) Appl. No.: 12/729,761

(22) Filed: Mar. 23, 2010

(51) Int. Cl.
*B08B 9/04* (2006.01)

(52) U.S. Cl. ..... 15/104.061; 15/104.05; 134/167 R

(58) Field of Classification Search ..... 15/3.5, 15/104.03, 104.05, 104.061; 134/167 C, 134/168 C; 166/222, 312, 383
See application file for complete search history.

(56) References Cited

U.S. PATENT DOCUMENTS

| | | | | |
|---|---|---|---|---|
| 5,086,842 | A * | 2/1992 | Cholet | 166/312 |
| 2004/0118565 | A1 * | 6/2004 | Crawford | 166/312 |
| 2005/0045210 | A1 * | 3/2005 | Baugh | 134/19 |

* cited by examiner

*Primary Examiner* — Michael Barr
*Assistant Examiner* — Saeed T Chaudhry
(74) *Attorney, Agent, or Firm* — Buskop Law Group, PC; Wendy Buskop

(57) ABSTRACT

One or more tubular cleaning devices and methods for cleaning a tubular are provided herein. The tubular cleaning device can include an inner tubular member having an inner tubular member inner bore formed therethrough. The inner tubular member can include a stop formed on a first portion thereof, a first connection end adjacent the stop, and a second connection end opposite the first connection end.

15 Claims, 4 Drawing Sheets

TUBULAR CLEANING DEVICE

FIELD

The present embodiments generally relate to a tubular cleaning device.

BACKGROUND

A need exists for a tubular cleaning device that has a shorter length than typical tubular cleaning devices and can maneuver or pass through sharp bends in the tubular.

A further need exists for a tubular cleaning device that can be adapted to be used with different heads depending on the application of the tubular cleaning device.

There is also a great need for a tubular cleaning device that allows for full bore return throughout the tubular and that is less subject to plugging.

A need also exists for a tubular cleaning device that doesn't depend on a decrease or increase in pressure to activate the change in direction.

The present embodiments meet these needs.

BRIEF DESCRIPTION OF THE DRAWINGS

The detailed description will be better understood in conjunction with the accompanying drawings as follows.

Figure 1:
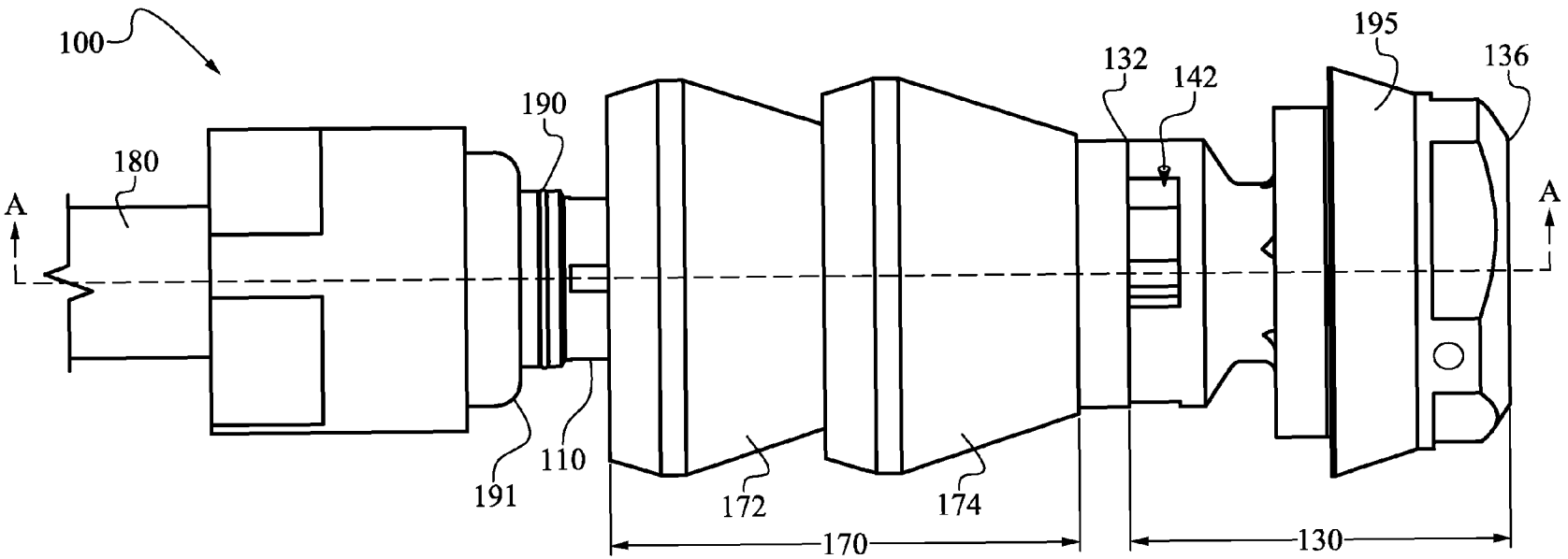
FIG. 1 is a side view of a tubular cleaning device according to one or more embodiments.

The present embodiments are detailed below with reference to the listed Figures.

DETAILED DESCRIPTION OF THE EMBODIMENTS

Before explaining the present apparatus in detail, it is to be understood that the apparatus is not limited to the particular embodiments and that it can be practiced or carried out in various ways.

The present embodiments relate to a tubular cleaning device.

One or more embodiments of the tubular cleaning device can include an inner tubular member. The inner tubular member can have an inner tubular member inner bore formed therethrough.

In addition, a stop can be formed on an inner tubular member first portion. For example, the inner tubular member first portion can be adjacent to one of the ends of the first tubular member. The stop can be formed on or into the outer wall of the inner tubular member. For example, the stop can be machined into the first portion of the inner tubular member.

In one or more embodiments, the inner tubular member can have a first connection end. The first connection end can be adjacent to the stop. The inner tubular member can also have a second connection end, which can be opposite the first connection end.

The second connection end can be connected to a nozzle. For example, the nozzle can have a first nozzle end connected to the second connection end.

The nozzle can have a nozzle inner bore. The nozzle inner bore can be in fluid communication with the inner tubular member inner bore. The nozzle inner bore can provide fluid communication between the first nozzle end and a second nozzle end. One or more notches can be formed into the first nozzle end.

In one or more embodiments, at least a portion of a first nozzle inner diameter end can be secured to a portion of an outer diameter of a second connection end of the inner tubular member. For example, the first nozzle end can be threadably secured to an outer diameter of the second connection end of the inner tubular member. Other connection devices or methods can be used. For example, snap latch connectors and other device can be used to connect the first nozzle end to the second connection end of the inner tubular member.

One or more through holes can be formed through a nozzle portion. The through hole can be isolated from the nozzle inner bore. The through hole can provide fluid communication between the first nozzle end and an area adjacent the second end. For example, the flow path can be between the first nozzle end and the second nozzle end. In another example, the flow path can be from the first nozzle end to an intermediate portion of the nozzle that is adjacent the second end of the nozzle.

In one or more embodiments, a nozzle seal can be disposed about the nozzle. The nozzle seal can be a flexible elastomeric moveable wear bushing. In other embodiments, the nozzle seal can be an elastomeric seal, such as an o-ring or a conical seal. The nozzle seal can be any seal configured to ensure flow through the nozzle through holes.

An outer tubular member can be slidably disposed about the inner tubular member. The outer tubular member can have one or more seals disposed thereon. For example, the outer tubular member can have a groove formed into an exterior portion thereof, and the seal can be disposed within the groove.

The seal can be an elastomeric seal. In one or more embodiments, the seal can include one or more conical portions. In one or more embodiments, one of the conical portions can overlap the other conical portion.

A flow path, such as a channel, can be formed between the inner tubular member and the outer tubular member.

In an embodiment, the flow path can be in an opened position when the outer tubular member is abutting the nozzle first end.

In another embodiment, the flow path can be in a closed position when the outer tubular member is abutting the stop.

A flow path seal can be disposed about the inner tubular member between the first connection end and the stop.

In one or more embodiments, a shoulder can be formed into the first connection end. The shoulder can mate with an outer tubular member first end. An inner shoulder can also be formed into the outer tubular member inner diameter.

The inner shoulder can mate with or engage the stop. For example, the inner shoulder can be engaged with the stop, and the shoulder can be engaged with the outer tubular member first end at the same time.

A tubing string can be connected to the first connection end. For example, the tubing string can be threadably secured to a first connection end inner diameter.

The tubing string can have a tubing string inner bore in fluid communication with the inner tubular member inner bore.

A method of cleaning a tubular can include using one or more of the above embodiments of the tubular cleaning device.

The method can include connecting a tubing string to the first connection end, and placing the tubular cleaning device into a pipe, such as a pipeline, a downhole tubular, a jumper, subsea umbilical components, or combinations thereof.

The method can further include flowing a fluid within the pipe. The fluid can push the outer tubular member towards the second connection end. The fluid can flow through the flow path to the through hole.

The fluid can flow from the first nozzle end to the second nozzle end via the through hole. The fluid can exit from the through hole into the pipe. A pressure build-up within the pipe can force the fluid back into the nozzle inner bore.

The pressure build-up within the pipe can be caused by a clog in the pipe. The clog can be caused by at least one of paraffin, particulates, salt block, asphaltenes, hydrates or combinations thereof.

The fluid can then flow through the nozzle inner bore, the inner tubular member inner bore, and the tubing string inner bore to an environment exterior to the pipe.

After one or more tasks are completed, the tubular cleaning device can be removed from the pipe.

In one or more embodiments, the removal of the tubular cleaning device can include flowing fluid into the tubing string inner bore into the inner tubular member inner bore, and flowing the fluid from the inner tubular member inner bore into the nozzle inner bore and into the pipe.

The fluid within the pipe adjacent the second nozzle end can flow into the through hole. The fluid can flow from the second nozzle end to the first nozzle end via the through hole.

As the fluid flows out of the first nozzle end, the fluid can slide the outer tubular member towards the stop, which prevents fluid flow through the flow path. In addition, the fluid exiting the through hole can apply force to the seal.

The embodiments of the tubular cleaning device can be better understood with reference to the Figures.

Referring now to FIG. 1, FIG. 1 is a side view of a tubular cleaning device according to one or more embodiments. The tubular cleaning device 100 can have a one or more seals (one is shown as 170) and a nozzle 130. A tubing string 180 can be connected to the tubular cleaning device 100.

The seal 170 can have any configuration and can be made from any material. For example, the seal 170 can have a first conical portion 172 and a second conical portion 174. The seal 170 can be made from an elastomeric material.

The nozzle 130 can have a first nozzle end 132. The first nozzle end 132 can have one or more notches 142. The nozzle 130 can also have a second nozzle end 136 opposite the first nozzle end 132.

A nozzle seal 195 can be disposed about the nozzle 130. The nozzle seal 195 can be a flexible elastomeric moveable wear bushing. The nozzle seal 195 can be made from rubber, another elastomeric material, or other materials capable of forming at least a partial seal. The nozzle seal 195 can be flexible or compressible to allow for a seal to form between a tubular, such as pipe, and the tubular cleaning device 100.

The inner tubular member 110 can have an inner tubular member outer shoulder 191 formed on the inner tubular member's outer diameter.

A flow path seal 190 can be disposed about the inner tubular member 110 adjacent the outer shoulder 191. The flow path seal 190 can be an o-ring or any type of elastomeric or metallic seal.

The tubular cleaning device 100 will be further explained with reference to FIGS. 2 and 3.

Figure 2:
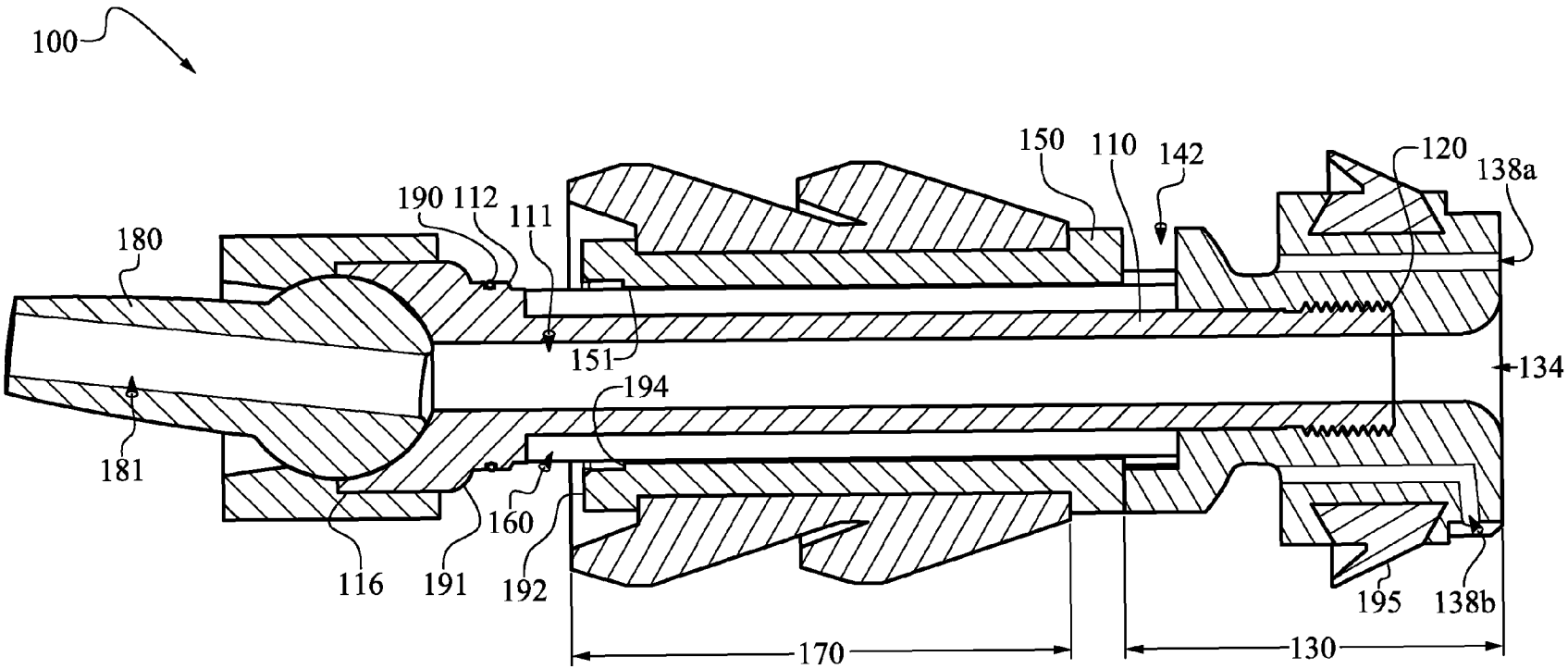
FIG. 2 is a cross-sectional view along line A-A when the tubular cleaning device is in a first configuration according to one or more embodiments.

FIG. 2 is a cross-sectional view along line A-A of FIG. 1 when the tubular cleaning device 100 is in a first configuration according to one or more embodiments.

Figure 3:
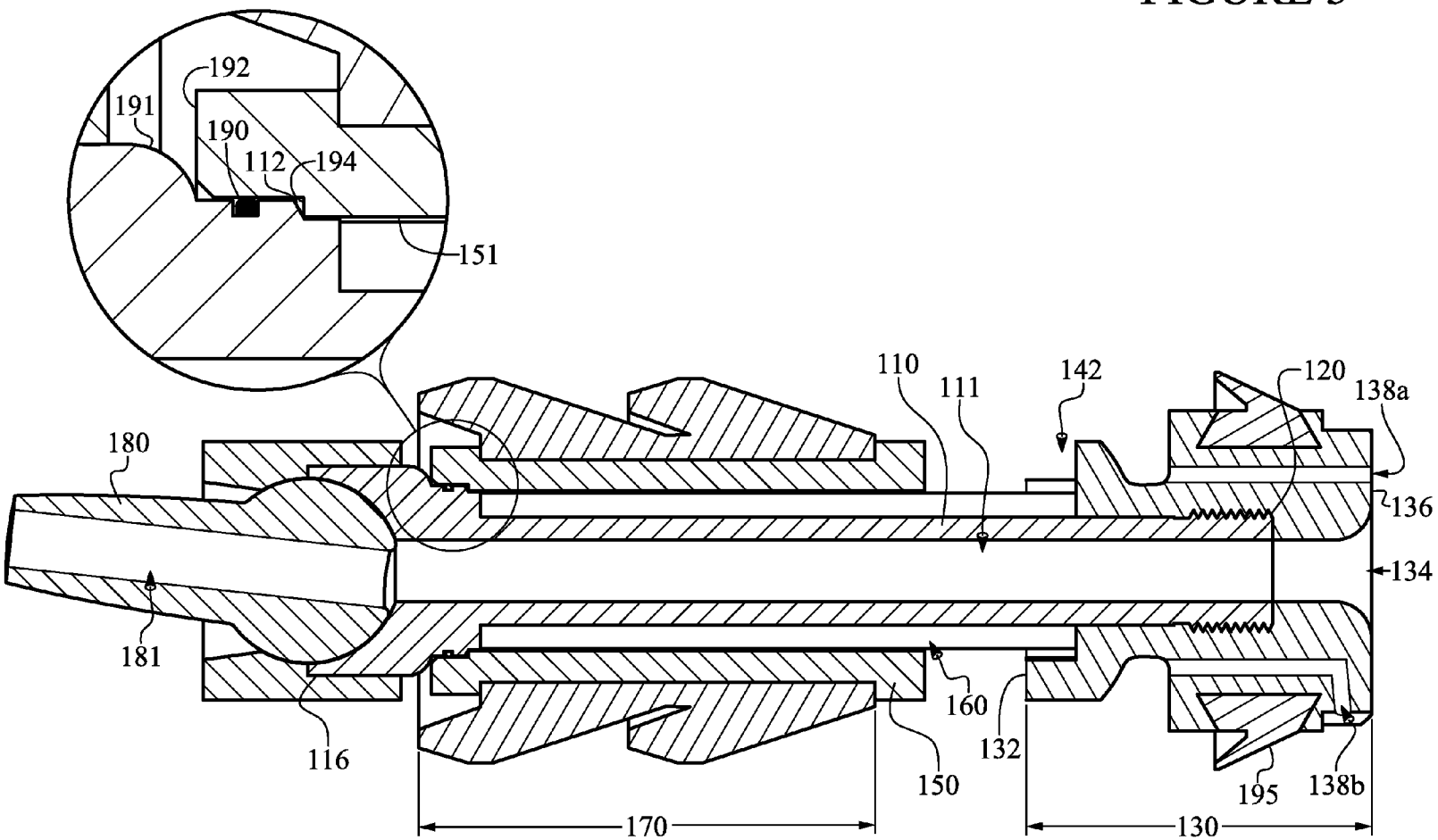
FIG. 3 is a cross-sectional view along line A-A when the tubular cleaning device of FIG. 1 is in a second configuration according to one or more embodiments.

FIG. 3 is a cross-sectional view along line A-A of FIG. 1 when the tubular cleaning device 100 of FIG. 1 is in a second configuration according to one or more embodiments.

Referring to both FIGS. 2 and 3, the tubular cleaning device 100 can include the inner tubular member 110. An outer tubular member 150 can be disposed about the inner tubular member 110.

The seal 170 can be disposed about the outer tubular member 150. For example, the outer tubular member 150 can have a groove or channel formed along the outer diameter of the outer tubular member. The seal 170 can sit within the groove or channel. In one or more embodiments, the groove can have one or more fingers that can protrude into the first conical portion 172 and second conical portion 174 to help secure the seal 170 within the groove.

The inner tubular member 110 can have a first connection end 116 and a second connection end 120. The first connection end 116 can be one end of an inner tubular member 110. The second connection end 120 can be the other end of the inner tubular member 110. The first connection end 116 can be connected to the tubing string 180. The tubing string 180 can have a tubing string inner bore 181 in fluid communication with an inner tubular member inner bore 111.

The nozzle 130 can be connected to the second connection end 120. A nozzle inner bore 134 can be formed through the nozzle 130 and can be in fluid communication with the inner tubular member inner bore 111. The nozzle inner bore 134 can provide fluid communication between the first nozzle end 132 and the second nozzle end 136. One or more through holes 138*a* and 138*b* can provide fluid communication between the first nozzle end 132 and the second nozzle end 136.

The outer tubular member 150 can slide or move about the inner tubular member 110. The position of the outer tubular member 150 on the inner tubular member 110 can either allow or prevent fluid flow through a flow path 160.

The flow path 160 can be disposed between the outer tubular member 150 and the inner tubular member 110. For example, one or more grooves can be formed into the outer diameter of the inner tubular member 110, and the groove can be encased or at least partially encased by the outer tubular member 150 and the first nozzle end 132.

The nozzle 130 can have one or more through holes 138*a* and 138*b* formed therethrough. The through holes 138*a* and 138*b* can be isolated from the nozzle inner bore 134. The through holes 138*a* and 138*b* can also provide fluid communication between the first nozzle end 132 and an area adjacent the second nozzle end 136. For example, the through hole 138*a* can provide fluid communication between the first nozzle end 132 and the second nozzle end 134 and the through hole 138*b* can provide fluid communication through the nozzle between a first seal side of the nozzle seal 195 and a second seal side of the nozzle seal 195. The through holes 138*a* and 138*b* can provide fluid communication from the first nozzle end to the second nozzle end or from the first nozzle seal side to the second nozzle seal side.

When the tubular cleaning device 100 is in the first configuration, as depicted in FIG. 2, fluid communication between the flow path 160 and the through holes 138*a* and 138*b* can be provided by the notches 142.

The inner tubular member outer shoulder 191 can be adjacent to the first connection end 116. A stop 112 can be formed on the inner tubular member's outer diameter. The stop 112 can be adjacent the inner tubular member outer shoulder 191.

A flow path seal 190 can be disposed about the inner tubular member 110 and between the stop 112 and the inner tubular member outer shoulder 191.

An inner shoulder 194 can be formed into or connected to the outer tubular member inner diameter 151. For example, the inner shoulder 194 can be machined into the outer tubular member inner diameter 151. In one or more embodiments, the inner shoulder 194 can be formed adjacent to an outer tubular member first portion 192.

Figure 4:
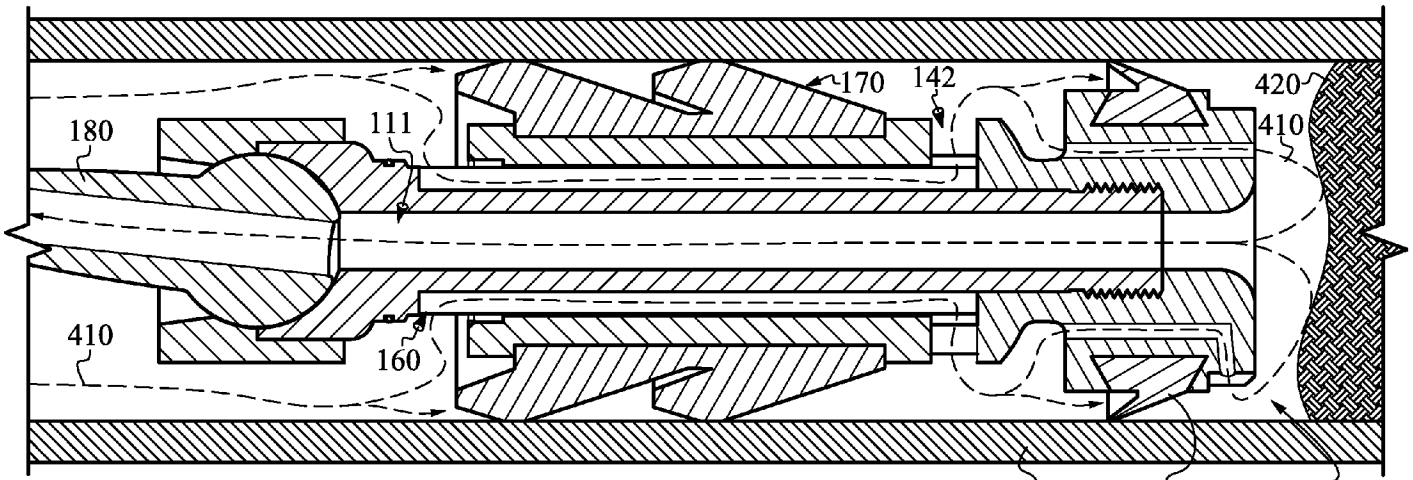
FIG. 4 depicts a schematic of the tubular cleaning device of FIG. 1 being inserted into a pipeline according to one or more embodiments.

FIG. 4 depicts a schematic of the tubular cleaning device of FIG. 1 being inserted into a pipe according to one or more embodiments. Referring now to FIGS. 2, 3, and 4 the operation of the tubular cleaning device 100 will be explained.

In operation, the tubing string 180 can be connected to the first connection end 116. For example, the inner diameter of the tubing string 180 can be threaded to the outer diameter of the fist connection end 116. After the tubing string 180 is connected to the first connection end 116, the tubular cleaning device 100 can be inserted into a tubular or pipe 400. The tubular or pipe can be a subsea pipeline, a surface pipeline, an underground pipeline, a subsea umbilical components, a tubular located within a wellbore, or combinations thereof.

The tubular cleaning device 100 can be forced or moved within the pipe 400 by a fluid 410 provided or pumped into the pipe 400. For example, the fluid 410 can flow within the pipe and exert a force on the seal 170. The force exerted on the seal 170 can move the outer tubular member 150 until the outer tubular member engages or touches the first nozzle end 132.

The fluid 410 can flow within the flow path 160 to the first nozzle end 132. At the first nozzle end 132, the fluid 410 can flow out of the flow path 160 through the notches 142. The fluid 410 can then flow into one or more of the through holes 138*a* and 138*b*. The fluid 410 can flow from the first nozzle end 132 to an area adjacent the second nozzle end 136 and into the inner diameter of the pipe 400. Pressure build up within the pipe 400 can cause the fluid 410 to flow into the nozzle inner bore 134.

Accordingly, the fluid 410 can exit the pipe 400 via the inner tubular member inner bore 111 and the tubing string inner bore 181 to an environment exterior of the pipe 400. The pressure build up in the pipe 400 can be caused by a clog 420 within the inner diameter of the pipe 400. Prior to the fluid 410 entering the nozzle inner bore 134 the fluid 410 can remove or penetrate a portion of the clog 420. The through holes 138*a* and 138*b* can provide a spiral or turbulent flow to the fluid 410.

As the tubular cleaning device 100 is inserted into the pipe 400, the nozzle seal 195 can force fluid flow through the nozzle through holes 138*a* and 138*b*, which creates a higher velocity fluid to help with the cleaning of the pipe 400.

It may be desirable to remove the tubular cleaning device 100 by reversing the tubular cleaning device 100 out of the pipe 400. Thus, FIG. 5 depicts a schematic of the tubular cleaning device of FIG. 1 being removed from the pipe of FIG. 4 according to one or more embodiments.

Figure 5:
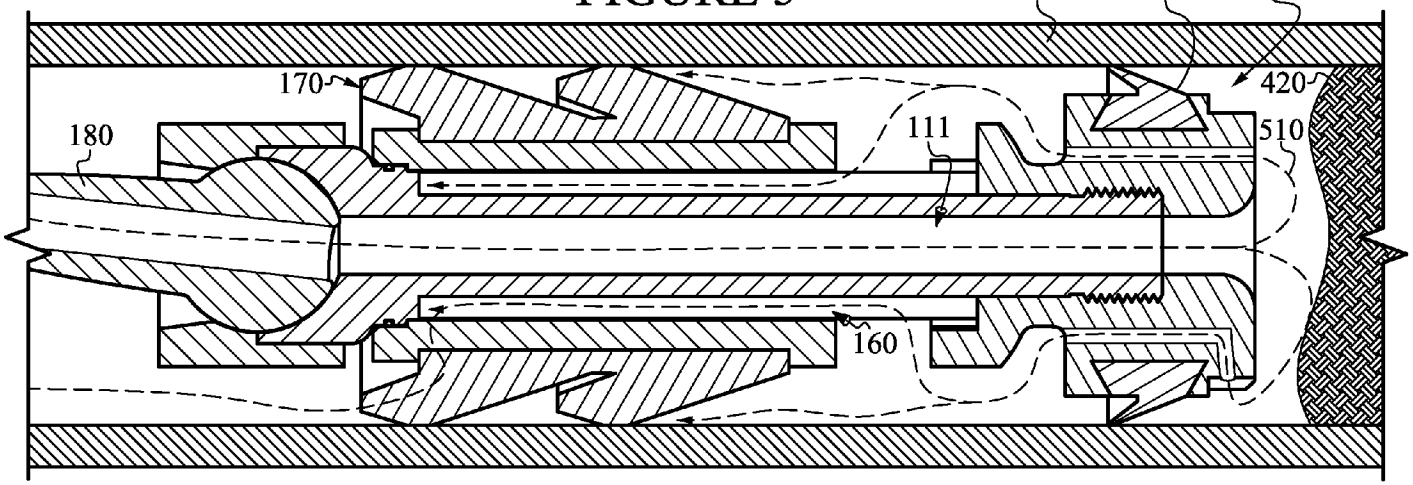
FIG. 5 depicts a schematic of the tubular cleaning device of FIG. 1 being removed from the pipeline of FIG. 4 according to one or more embodiments.

Referring to FIGS. 2, 3, and 5, the tubular cleaning device 100 can be removed from the pipe 400 by pumping or providing a fluid 510 to the tubing string inner bore 181. The fluid 510 can flow through the inner tubular member inner bore 111 and the nozzle inner bore 134 to the inner diameter of the pipe 400.

The pressure build up in the pipe 400, caused by the clog 420 can cause the fluid 510 to flow into one or more of the through holes 138*a* and 138*b*. Accordingly, the fluid 510 can travel from the second nozzle end 136 to the first nozzle end 132 via the through holes 138*a* and 138*b*. The fluid 510 can exit the through holes 138*a* and 138*b* and provide a force to the seal 170.

The force applied to the seal 170 by the fluid 510 can move the outer tubular member 150 in a direction away from the nozzle 130 until the outer tubular member 150 engages the stop 112. For example, the inner shoulder 194 can engage the stop 112, and the outer tubular member first portion 192 can engage the inner tubular member outer shoulder 191. Accordingly, fluid flow out of the flow path 160 can be prevented. In this position pressure builds up against the seal 170 and pushes the tubular cleaning device 100 out of the pipe 400.

As the tubular cleaning device 100 is removed from the pipe 400, the nozzle seal 195 can provide additional pushing force to reclaim the tubular cleaning device 100 from pipe 400.

While these embodiments have been described with emphasis on the embodiments, it should be understood that within the scope of the appended claims, the embodiments might be practiced other than as specifically described herein.

What is claimed is:

1. A tubular cleaning device comprising:

a. an inner tubular member having an inner tubular member inner bore formed therethrough, wherein the inner tubular member comprises:
   (i) a stop formed on a first portion thereof;
   (ii) a first connection end adjacent the stop; and
   (iii) a second connection end opposite the first connection end;

b. a nozzle comprising a first nozzle end connected to the second connection end of the inner tubular member, wherein the nozzle further comprises:
   (i) a nozzle inner bore in fluid communication with the inner tubular member inner bore, wherein the nozzle inner bore provides fluid communication between the first nozzle end and a second nozzle end;
   (ii) a through hole formed through the nozzle, wherein the through hole is isolated from the nozzle inner bore, and wherein the through hole provides fluid communication between the first nozzle end and an area adjacent to the second nozzle end; and
   (iii) a notch formed into the first nozzle end;

c. an outer tubular member slidably disposed about the inner tubular member;

d. a flow path formed between the inner tubular member and the outer tubular member; and e. a seal disposed about the outer tubular member.

2. The tubular cleaning device of claim 1, wherein the outer tubular member has a groove formed in an exterior portion thereof, and wherein the seal is disposed within the groove.

3. The tubular cleaning device of claim 1, wherein the seal is an elastomeric seal.

4. The tubular cleaning device of claim 1, wherein the seal comprises a conical portion.

5. The tubular cleaning device of claim 1, wherein the flow path is in an opened position when the outer tubular member is abutting the nozzle first end.

6. The tubular cleaning device of claim 1, wherein the flow path is in a closed position when the outer tubular member is abutting the stop.

7. The tubular cleaning device of claim 1, further comprising a nozzle seal disposed about the nozzle, wherein the nozzle seal has a first seal side adjacent the first nozzle end and a second seal side opposite the first seal side.

8. The tubular cleaning device of claim 7, wherein the nozzle seal is a flexible elastomeric moveable wear bushing.

9. The tubular cleaning device of claim 7, wherein the through hole provides a flow path through the nozzle from the first nozzle end to the second side of the nozzle seal.

10. The tubular cleaning device of claim 1, further comprising a seal disposed about the inner tubular member between the first connection end and the stop.

11. The tubular cleaning device of claim 1, further comprising an outer shoulder formed into the first connection end, wherein the outer shoulder is configured to mate with an outer tubular member first end.

12. The tubular cleaning device of claim 10, further comprising an inner shoulder disposed on an outer tubular member inner diameter, wherein the inner shoulder is configured to engage the stop and allow the inner shoulder to mate with the outer tubular member first end at the same time.

13. The tubular cleaning device of claim 1, wherein at least a portion of a first nozzle inner diameter end is secured to a portion of a second connection end of the inner tubular member outer diameter.

14. The tubular cleaning device of claim 13, wherein the first nozzle inner diameter end is threadably secured to an outer diameter of the second connection end of the inner tubular member.

15. The tubular cleaning device of claim 1, wherein the through hole provides a flow path between the first nozzle end and the second nozzle end.

* * * * *